US010322421B2

(12) United States Patent
Lo

(10) Patent No.: US 10,322,421 B2
(45) Date of Patent: Jun. 18, 2019

(54) SPRINKLER

(71) Applicant: YUAN-MEI CORP., Changhua County (TW)

(72) Inventor: Shun-Nan Lo, Changhua County (TW)

(73) Assignee: YUAN-MEI CORP., Changhua County (TW)

( * ) Notice: Subject to any disclaimer, the term of this patent is extended or adjusted under 35 U.S.C. 154(b) by 457 days.

(21) Appl. No.: 15/008,457

(22) Filed: Jan. 28, 2016

(65) Prior Publication Data

US 2016/0303583 A1 Oct. 20, 2016

Related U.S. Application Data

(63) Continuation-in-part of application No. 14/685,606, filed on Apr. 14, 2015.

(51) Int. Cl.
*B05B 3/04* (2006.01)
*B05B 1/16* (2006.01)

(52) U.S. Cl.
CPC ..... *B05B 3/0422* (2013.01); *B05B 1/169* (2013.01); *B05B 1/1645* (2013.01); *B05B 3/0431* (2013.01)

(58) Field of Classification Search
CPC ..... B05B 3/0422; B05B 1/1645; B05B 1/169; B05B 3/0431; B05B 3/04; B05B 3/0418; B05B 3/044; B05B 3/0409
USPC ..... 239/246, 498, 524, 539, 249, 263.3
See application file for complete search history.

(56) References Cited

U.S. PATENT DOCUMENTS

| | | | | |
|---|---|---|---|---|
| 965,941 | A | 8/1910 | Robertson | |
| 1,871,258 | A | 8/1932 | Coles et al. | |
| 1,919,196 | A | 7/1933 | Brooks | |
| 2,090,406 | A * | 8/1937 | Thompson | B05B 3/063 239/222.13 |
| 2,313,994 | A | 3/1943 | Grant | |
| 2,726,119 | A | 12/1955 | Egly et al. | |
| 2,970,774 | A | 2/1961 | Li | |
| 3,033,467 | A | 5/1962 | Hofer | |
| 3,038,666 | A | 6/1962 | Dudley et al. | |
| 3,081,950 | A | 3/1963 | Rinkewich | |
| 3,094,283 | A | 6/1963 | Balister | |
| 3,112,883 | A | 12/1963 | Blanchard | |
| 3,149,784 | A | 9/1964 | Skidgel | |
| 3,383,047 | A | 5/1968 | Hauser | |
| 3,464,628 | A | 9/1969 | Chow | |
| 3,645,451 | A | 2/1972 | Hauser | |

(Continued)

*Primary Examiner* — Viet Le
(74) *Attorney, Agent, or Firm* — Raymond Y. Chan; David and Raymond Patent Firm

(57) ABSTRACT

A sprinkler includes a housing having a tubular axle, a control device including a base coupled at the housing, a bridge upwardly extended from the tubular axle, a first cover including a top platform and an assembling unit downwardly extended from the top platform, and a second cover, having a center through hole, coupled at a top rim of the base. The bridge has two or more bridge ribs and the assembly unit has two or more corresponding windows. The first cover is coupled at the second cover at a position that the assembling unit is downwardly extended through the center through hole until the in center through hole is covered by the top platform, such that the bridge ribs of the bridge are engaged with the windows of the assembling unit of the first cover to securely couple the control device with the housing in a screw-less manner.

14 Claims, 4 Drawing Sheets

(56) References Cited

U.S. PATENT DOCUMENTS 3,655,132 A 4/1972 Rosic
3,758,038 A 9/1973 Ridgway
3,785,565 A 1/1974 Perry et al.
3,878,990 A 4/1975 Geraudie
3,915,383 A 10/1975 King
3,921,912 A 11/1975 Hayes
3,934,820 A * 1/1976 Phaup ..... B05B 3/0436 239/205
D239,174 S 3/1976 Raffler
3,998,390 A 12/1976 Peterson
4,069,976 A 1/1978 Chauvigne'
D250,769 S 1/1979 Dadson
D254,087 S 1/1980 Dadson
4,201,344 A 5/1980 Lichte
4,235,379 A 11/1980 Beamer
4,253,608 A 3/1981 Hunter
4,303,201 A 12/1981 Elkins et al.
4,335,852 A 6/1982 Chow
4,347,981 A 9/1982 Hayes
4,353,506 A * 10/1982 Hayes ..... B05B 3/0454 239/206
4,417,691 A 11/1983 Lockwood
4,471,908 A 9/1984 Hunter
4,486,907 A * 12/1984 Carter ..... E04H 4/169 134/167 R
D277,777 S 2/1985 Lemkin
4,501,391 A 2/1985 Hunter
4,534,512 A 8/1985 Chow et al.
D282,769 S 2/1986 Lemkin
4,597,528 A 7/1986 Caruana
4,613,077 A 9/1986 Aronson
4,624,412 A 11/1986 Hunter
4,625,914 A 12/1986 Sexton
RE32,386 E 3/1987 Hunter
4,708,290 A 11/1987 Osmond
D297,042 S 8/1988 Evans
D297,255 S 8/1988 Henken
4,760,958 A 8/1988 Greenberg
4,773,595 A 9/1988 Livne
4,787,558 A 11/1988 Sexton et al.
4,819,875 A 4/1989 Beal
4,867,378 A * 9/1989 Kah, Jr. ..... B05B 1/26 239/206
4,867,379 A 9/1989 Hunter
D305,791 S 1/1990 Lang
D305,792 S 1/1990 Hastings
4,892,252 A 1/1990 Bruninga
D305,925 S 2/1990 Hastings et al.
4,903,897 A 2/1990 Hayes
4,919,337 A 4/1990 Van Leeuwen
D309,772 S 8/1990 Hastings et al.
5,007,586 A * 4/1991 Cohen ..... B05B 3/005 239/222.17
5,031,833 A 7/1991 Alkalay
5,048,757 A 9/1991 Van Leeuwen
5,052,621 A 10/1991 Katzer
5,086,977 A 2/1992 Kah, Jr.
5,098,021 A 3/1992 Kah, Jr.
5,104,045 A 4/1992 Kah, Jr.
5,115,977 A 5/1992 Alkalay
5,123,597 A * 6/1992 Bendall ..... B05B 1/34 239/124
5,141,157 A 8/1992 Han et al.
5,213,016 A 5/1993 Kah, Jr.
5,226,599 A * 7/1993 Lindermeir ..... B05B 15/70 239/205
5,348,228 A 9/1994 Wang
D358,449 S 5/1995 Ford
5,423,486 A 6/1995 Hunter
5,526,982 A 6/1996 McKenzie
D374,914 S 10/1996 Wang
D378,399 S 3/1997 Simonetti
5,611,488 A 3/1997 Frolich
5,746,374 A * 5/1998 Simonetti ..... B05B 1/1645 239/240
5,765,757 A 6/1998 Bendall
5,769,322 A 6/1998 Smith
5,826,797 A * 10/1998 Kah, III ..... B05B 1/1645 239/344
6,085,995 A 7/2000 Kah, Jr. et al.
6,138,924 A 10/2000 Hunter
6,182,909 B1 2/2001 Kah, Jr. et al.
6,237,862 B1 5/2001 Kah, III et al.
6,601,781 B2 8/2003 Kah, III et al.
6,869,026 B2 * 3/2005 McKenzie ..... B05B 3/0431 239/237
7,032,836 B2 * 4/2006 Sesser ..... B05B 15/70 239/204
8,074,897 B2 * 12/2011 Hunnicutt ..... B05B 3/003 239/204
8,272,578 B1 * 9/2012 Clark ..... B05B 1/1663 239/237
8,348,179 B2 * 1/2013 Wang ..... B05B 3/0422 239/240
8,636,233 B2 * 1/2014 Clark ..... B05B 15/70 239/581.1
8,695,900 B2 * 4/2014 Hunnicutt ..... B05B 1/304 239/224
8,746,592 B2 * 6/2014 Lo ..... B05B 1/3026 239/240
8,789,768 B2 * 7/2014 Hunnicutt ..... B05B 3/003 239/204
9,156,043 B2 * 10/2015 Walker ..... B05B 1/326
2001/0013557 A1 * 8/2001 Kah, III ..... B05B 1/1645 239/391
2005/0194464 A1 * 9/2005 Bruninga ..... B05B 15/70 239/200
2009/0140076 A1 * 6/2009 Cordua ..... B05B 1/3026 239/457
2010/0301130 A1 * 12/2010 Townsend ..... B05B 1/1681 239/11
2010/0301135 A1 * 12/2010 Hunnicutt ..... B05B 1/304 239/222.17
2011/0259975 A1 * 10/2011 Lo ..... B05B 1/262 239/99
2011/0259977 A1 * 10/2011 Lo ..... B05B 15/70 239/240
2011/0284659 A1 * 11/2011 Lo ..... B05B 15/70 239/201
2012/0056010 A1 * 3/2012 Lo ..... B05B 1/1636 239/101
2012/0312898 A1 * 12/2012 Sesser ..... A01G 25/16 239/394
2014/0263732 A1 * 9/2014 Heren ..... B05B 1/1654 239/201
2015/0251197 A1 * 9/2015 Lo ..... B05B 1/30 239/457

* cited by examiner

SPRINKLER

CROSS REFERENCE OF RELATED APPLICATION

This is a continuation-in-part application that claims the benefit of priority under 35 U.S.C. § 119 to a non-provisional application, application Ser. No. 14/685,606, filed Apr. 14, 2015.

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to an irrigation device, and more particularly to an above ground sprinkler with adjustable spray volumes and patterns.

Description of Related Arts

Generally, there are various irrigation systems available now. An above-ground sprinkler is one of the irrigation systems that provides multiple irrigation modes. For example, the above-ground sprinkler is connected to a garden hose and is set at a specific zone for controlling irrigation areas. Moreover, the above-ground sprinkler can serve as a supplemental water source for providing additional water at the insufficient watering area. Alternatively, the above-ground sprinkler can be used as a main water source at specific zones and can be moved to from one specific position to the other for irrigation.

Referring to U.S. Pat. No. 7,090,146, an above-ground adjustable spray pattern sprinkler is disclosed. The above-ground sprinkler includes a head that rotates about an angle determined by a pair of arc adjustment rings. Rotation of the head is driven by a drive mechanism with a rotor rotationally driven by fluid flowing to the head. The drive mechanism includes a valve disposable in two positions for control of the direction in which the rotor rotates. A reduction gear drive transmits torque from the rotor to the head to drive the head to rotate. The head includes a cover with an outlet aperture and a flow control member that rotates within the cover to dispose one of nozzles in alignment with the outlet aperture. A deflection screw or a slider with a plurality of deflectors may be used to provide variable deflection of water sprayed from the outlet aperture.

The cover also has a shaft extended through the central opening of the plate of the flow control member. The shaft has a bore that is threaded to receive the attachment screw. The interior shelf of the opening of the cap may be aligned and flushed with the end of the flow control member when the head is assembled so that installation of the attachment screw tends to keep the cap and the flow control member in place, with respect to the cover.

Additionally, the cover has a detent mechanism positioned on the plate. The detent mechanism may be in a form of a ball-and-spring detent. The plate may have a plurality of indentations and/or ridges (not shown) aligned with the extension tubes so that the ball is able to slide toward the plate when each extension tube is aligned with the outlet aperture. Hence, the detent mechanism resists rotation of the flow control member that moves any of the extension tubes out of alignment with the outlet aperture.

Moreover, the cover and the flow control member may be assembled together via an attachment screw. After the remaining components of the sprinkler have been assembled, the deflector flow control member may be rotatably coupled to the cap via the attachment screw. The flow control member and the cap are attached to the cover by an attachment screw. The cap is held in place also by the attachment screw. In summary, the attachment screw holds the cap, the follow control member and the cover together. The flow control member is rotatable about the generally vertical axis to align any of the tubular extensions with the outlet aperture.

SUMMARY OF THE PRESENT INVENTION

According to the present invention, the foregoing and other objects and advantages are attained by a sprinkler which comprises a main body. The main body comprises a housing and a control device. The housing has a first end and a second end. The first end of the housing has a hose connecting structure for connecting with a water source via a water hose or a water pipe. The second end of the housing has a connecting unit.

The main body further comprises a driven mechanism supported in the housing, wherein the driven mechanism is preferably a driver gear being driven to rotate by water pressure and water flowing direction, so as to control the rotatable irrigating direction of the sprinkler. Accordingly, the first end of the housing is connected to a water hose operatively linked to a water source while the second end of the housing is operatively coupled with the control device.

The control device comprises a base, a first cover, a second cover, and an adjustment unit. The base comprises a tubular sleeve and a plurality of guiding conduits radially extended from the tubular sleeve. The control device further comprises a plurality of nozzle heads coupled at the guiding conduits respectively, wherein the nozzle heads have different spraying patterns.

The first cover comprises a top platform and an assembling unit downwardly extended from the top platform. The assembling unit has at least two symmetrical windows, wherein the windows are preferably aligned with each other. The second cover has a center through hole and a leg fringe downwardly extended from a surrounding wall of the center through hole.

The connecting unit of the housing comprises a tubular axle. The main body further comprises a bridge. The tubular axle has a vertical water channel, wherein the water channel is communicatively linked to an accommodating cavity of the housing for allowing the water to flow from the accommodating cavity to the water channel. The tubular axle further has a plurality of lateral water passageways radially and outwardly extended from the water channel. The bridge has two or more edge sides and two or more bridge ribs formed thereat.

Accordingly, the inner diameter of the bottom rim of the base matches with the outer diameter of the second end of the housing. The outer diameter of the outer rim of the second cover matches with the diameter of the top end of the base. The first cover is coupled at the central through hole of the second cover at a position that the bridge ribs of the bridge are engaged with the windows of the assembling unit of the first cover respectively when the first cover is pressed downwardly. As a result, the control device is securely coupled at the housing.

These and other objectives, features, and advantages of the present invention will become apparent from the following detailed description, the accompanying drawings, and the appended claims.

DETAILED DESCRIPTION OF THE PREFERRED EMBODIMENT

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

With the aids of the Figures shown below, the content of techniques, features, and embodiments of the present invention is herein described, so as for the examiners to further understand the present invention.

Figure 1:
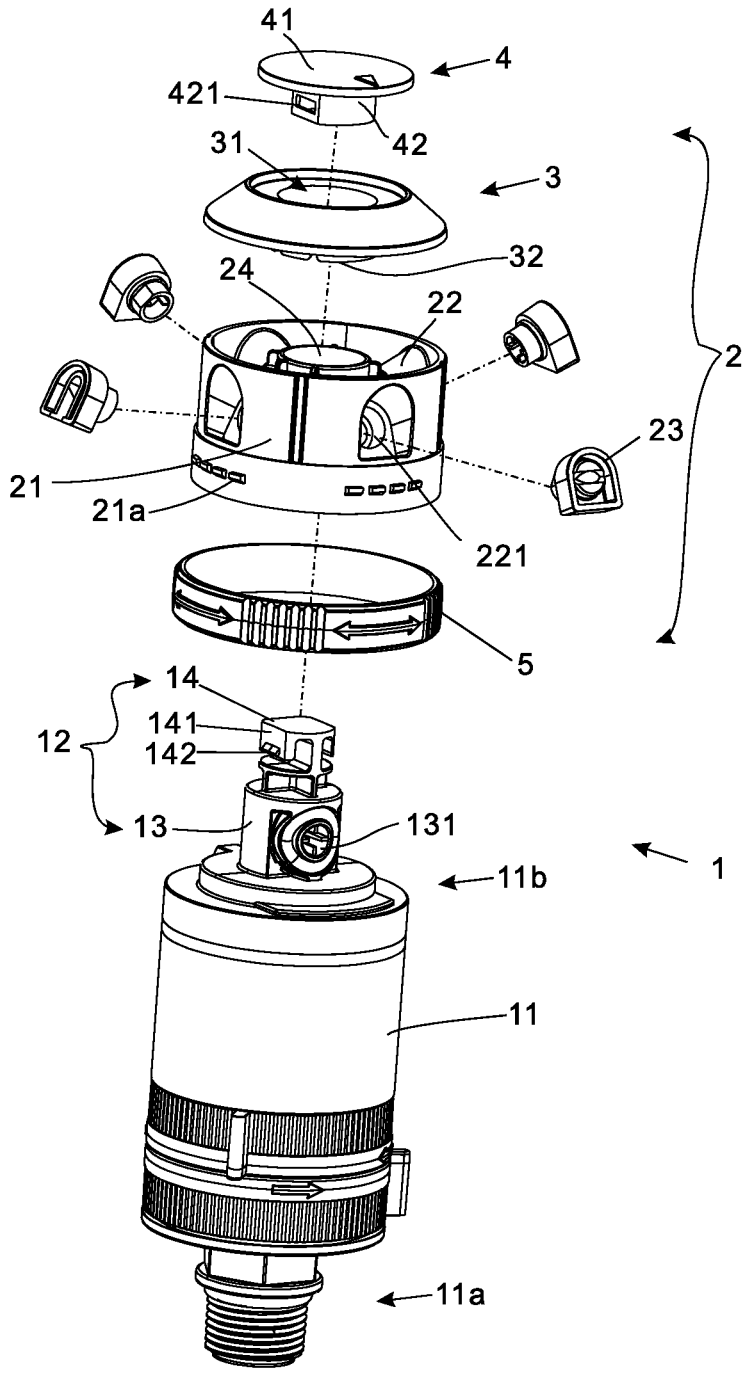
FIG. 1 is an exploded perspective view of a sprinkler according to a preferred embodiment of the present invention.
Figure 2:
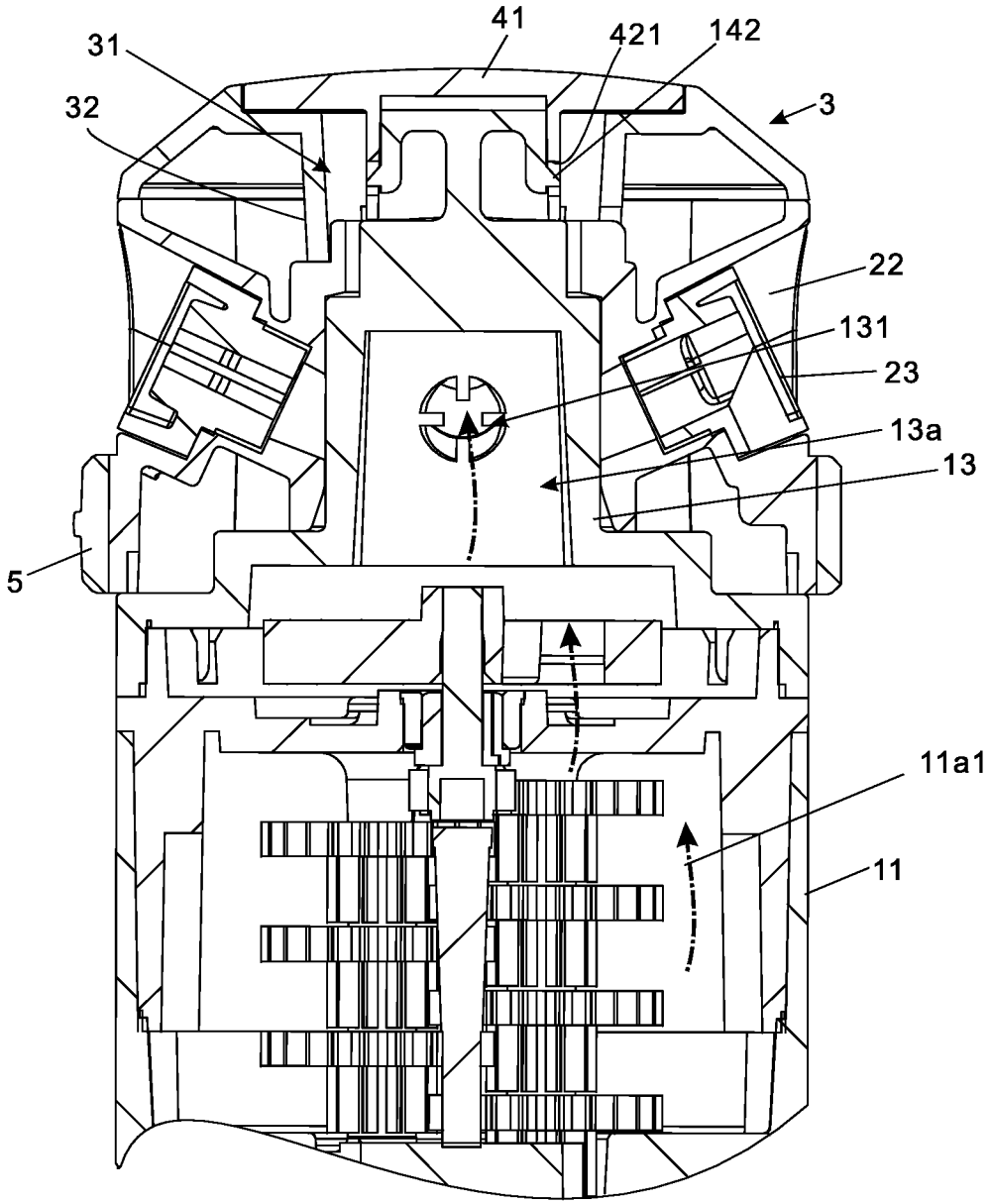
FIG. 2 is a partially sectional view of the sprinkler according to the above preferred embodiment of the present invention.
Figure 3:
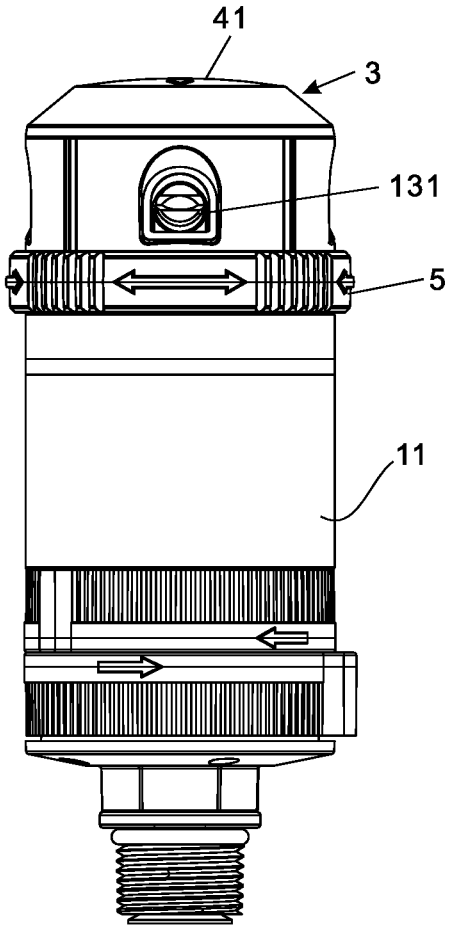
FIG. 3 is a front view of the sprinkler according to the above preferred embodiment of the present invention.

Referring to FIGS. 1 to 3 of the drawings, the sprinkler comprises a main body 1, wherein the main body 1 comprises a housing 11, a control device 2, and a first cover 4. The housing 11 has a first end 11*a* and a second end 11*b*. The first end 11*a* of the housing 11 has a hose connecting structure located at a bottom end of the housing 11 for connecting with a water source via a water hose or a water pipe. The second end of the housing 11 is formed on top of the housing 11 and is preferably coaxial with the first end 11*a* of the housing 11. The second end 11*b* of the housing 11 is upwardly extended and formed a connecting unit 12. The connecting unit 12 is coaxially extended from the second end 11*b* of the housing 11 and is operatively coupled with the control device 2. The main body 1 further comprises a driven mechanism 111, which is preferably a driven gear unit, supported in the housing 11, wherein the driven mechanism 111 is driven to rotate by water pressure and water flowing direction, so as to control the rotatable irrigating direction of the sprinkler.

The control device 2 comprises a base 21, a second cover 3, and an adjustment ring 5. The base 21 comprises a tubular sleeve 24 and a plurality of guiding conduits 22 radially extended from the tubular sleeve 24. The base 21 has a protruding rim 21*a* radially protruded from a bottom rim of the base 21, wherein a diameter of the protruding rim 21*a* is larger than a diameter of the upper portion of the base 21. The control device 2 further comprises a plurality of nozzle heads 23 coupled at the guiding conduits 22 respectively and radially supported at a peripheral wall of the base, wherein the nozzle heads 23 have different spraying patterns. According to the preferred embodiment, there are at least four nozzle heads 23, wherein each of the nozzle heads 23 has one or more spraying outlets, wherein the spraying outlets have different shape configurations for providing different spraying patterns.

The first cover 4 comprises a top platform 41 and an assembling unit 42 downwardly extended from the top platform 41. The assembling unit 42 has at least two symmetrical windows 421, wherein the windows 421 are preferably aligned with each other. The second cover 3 has a center through hole 31 and a leg fringe 32 downwardly extended from a surrounding wall of the center through hole 31.

The connecting unit 12 of the housing 11 comprises a tubular axle 13 having a vertical water channel 13*a*, wherein the water channel 13A is communicatively linked to an accommodating cavity 11*a*1 of the housing for allowing the water to flow from the accommodating cavity 11*a*1 to the water channel 13*a*. The tubular axle 13 further has a plurality of lateral water passageways 131 radially and outwardly extended from the water channel 13*a* to guide the water to flow from the water channel 13*a* to the water passageways 131. Accordingly, the top end of the tubular axle 13 is a closed end and the bottom end thereof is an opened end. The main body 10 further comprises a bridge 14 integrally extended from the top end of the tubular axle 13, wherein the bridge 14 has two or more edge sides 141 and two or more bridge ribs 142 formed thereat.

The adjustment ring 5 is coaxially coupled at the base 21, wherein an inner diameter of the adjustment ring 5 matches with an outer diameter of the protruding rim 21*a*, such that the adjustment ring 5 is coaxially coupled at the protruding rim 21*a* to drive the base 21 to rotate when the adjustment ring 5 is rotated. It is worth mentioning that when the base 21 is rotated, the tubular axle 13, the bridge 14, the first cover 4, and the second cover 3 are stationary that they will not be rotated correspondingly.

The assembling method of the sprinkler of the present invention comprises the following steps.

(1) Extend the connecting portion 12 of the housing 11 through the tubular sleeve 24 of the control device 2 until the top portion of the connecting portion 12 is located above the open top end of the tubular sleeve 24. In other words, the bridge 14 is located above the top end of the tubular sleeve 24 to ensure the bridge 14 to be aligned with the center through hole 31 of the second cover 3.

(2) Securely couple the first cover 4 onto the connecting portion 12, wherein the first cover 4 is pressed to tightly engage with the connecting portion 12 to prevent the first cover 4 being detached from the connecting portion 12, such that the control device 12 is secured to the housing 11 to ensure the rotational movement of the control device 12 with respect to the housing 11.

According to the preferred embodiment, the inner diameter of the bottom rim of the base 21 matches with an outer diameter of the second end of the housing 11, such that the base 21 is coaxially coupled on top of the housing 11. The outer rim of the second cover 3 is fittingly coupled at a top end of the base 21, wherein the first cover 4 is coupled at the second cover 3 at a position that the assembling unit 42 is downwardly extended through the center through hole 31 until the center through hole 31 is covered by the top platform 41, such that the bridge ribs 142 of the bridge 14 are engaged with the windows 421 of the assembling unit 42 of the first cover 4 respectively when the first cover 4 is pressed downwardly. As a result, the control device 2 is securely coupled at the housing 11 as shown in FIG. 2.

Accordingly, the control device 2 is provided at the top end of the housing 11, wherein the guiding conduits 22 of the base 21 are radially extended from the tubular sleeve 24 thereof to an outer peripheral wall of the base 21. The nozzles 23 are provided at outlet ends of the water conduits 22 respectively. It is worth mentioning that the nozzles 23 provide different spraying patterns respectively. The adjustment ring 5 is coaxially coupled at the bottom end of the base 21.

The tubular axle 13 is upwardly, integrally, and coaxially extended from a center of the housing 11, wherein the water channel 13*a* is formed within the tubular axle 13 and is orientated in a vertical configuration. It is worth mentioning that the top end of the water channel 13*a* is a closed end. The water passageways 131 are radially extended from the water channel 13*a*. Preferably, the water passageways 131 are perpendicular to the water channel 13*a* at a position below the closed top end thereof. The bridge 14 is integrally extended from the top end of the tubular axle 13, wherein the bridge ribs 142 at the edge sides 141 of the bridge 14 are engaged with the windows 421 of the first cover 4. In particular, when the tubular axle 13 is inserted through the tubular sleeve 24 of the base 21 and when the second cover 3 is engaged with the top rim of the base 21, the first cover 4 is coupled at the center through hole 31 of the second cover 3. Therefore, when a downward force is applied on the first cover 4, the bridge ribs 142 are forced to engage with the windows 421 of the first cover 4 to ensure the securely locking engagement between the control device 2 and the housing 11.

The adjustment ring 5 is coupled between the housing 11 and the base 21. In particular, the adjustment ring 5 is coaxially coupled around an outer peripheral surface of the base 21 at the bottom rim thereof. Accordingly, the adjustment ring 5 is manually driven to rotate by the user. When the adjustment ring 5 is rotated, the base 21 is driven to rotate correspondingly to selectively align each of the water passageways 131 with one of the water conduits 22.

According to the preferred embodiment, the attachment between the housing 11 and the control device 2 is a quick attachment and does not require any attachment screw. It is worth mentioning that the housing 11 and the control device 2 are tightly coupled by the engagement between the bridge ribs 142 of the housing 11 and the windows 421 of the first cover 4, such that the control device 2 cannot be detached from the housing 11. In other words, the attachment between the housing 11 and the control device 2 is a screw-less attachment.

Figure 4:
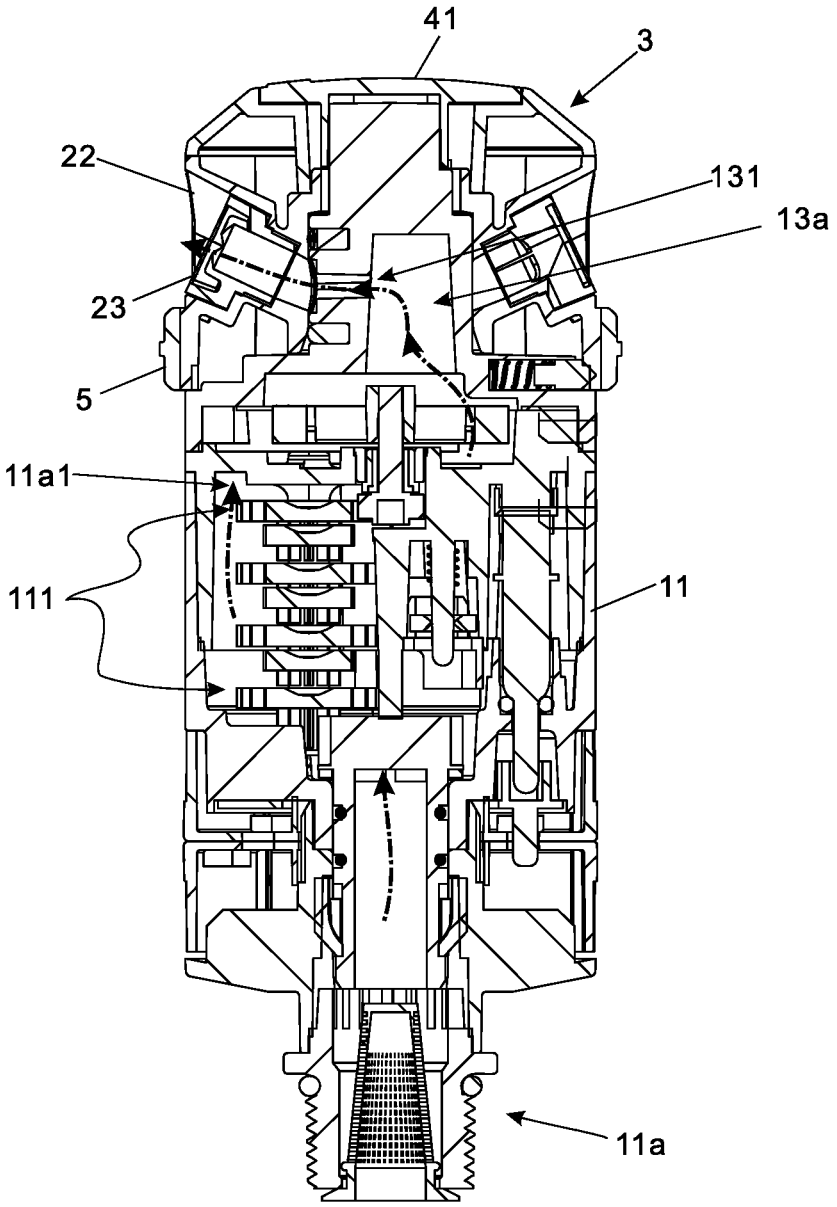
FIG. 4 is a sectional view of the sprinkler according to the above preferred embodiment of the present invention.

As shown in FIG. 4, the driven mechanism 111 is received in the housing 11, wherein the driven mechanism 111 is constructed to include driven gears, a valve assembly, cog gears, and rotor. When the valve assembly is actuated to open for controllably allowing the water to enter into the accommodating cavity 11*a*1, the rotor is rotated at either a clockwise direction or a counterclockwise direction to synchronously control a rotational direction of the housing 11. As a result, the sprinkler of the present invention provides two revisable spraying directions that the sprinkler can spray at either the clockwise direction or the counterclockwise direction. It is worth mentioning that the driven mechanism 111 is operated by the water pressure and the water flowing direction. Other mechanisms worked with water pressure and the water flowing direction can be incorporated with the sprinkler of the present invention.

Accordingly, when the water enters into the accommodating cavity 11*a*1 of the housing 11, the water is guided to flow into the water channel 13*a* through the tubular axle 13. When the adjustment ring 5 is rotated to drive the base 21 to rotate correspondingly, the water channel 13*a* is selectively aligned with an inlet end of the water conduit 22, such that the water is guided to flow from the outlet end 221 of the water conduit 22 to the corresponding nozzle 23 for spraying the water out of the sprinkler.

One skilled in the art will understand that the embodiment of the present invention as shown in the drawings and described above is exemplary only and not intended to be limiting. It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A sprinkler, comprising: a housing having an accommodating cavity, a first end adapted for connecting with a water source to guide water to enter into said accommodating cavity, an opposed second end, and a tubular axle upwardly extended from said second end; a control device comprising a base coupled at said housing and a plurality of nozzles radially supported at a peripheral wall of said base for selectively spraying the water at different spraying patterns; a bridge upwardly extended from a top end of said tubular axle, wherein said bridge has two or more bridge ribs forms thereat; a first cover comprising a top platform and an assembling unit downwardly extended from said top platform, wherein said assembling unit has at least two symmetrical windows; and a second cover, having a center through hole, coupled at a top rim of said base, wherein said first cover is coupled at said second cover at a position that said assembling unit is downwardly extended through said center through hole until said center through hole is covered by said top platform, such that said bridge ribs of said bridge are engaged with said windows of said assembling unit of said first cover to securely couple said control device with said housing in a screw-less manner.

2. The sprinkler, as recited in claim 1, wherein said bridge is integrally extended from said top end of said tubular axle and has two or more edge sides that said bridge ribs are formed at said edge sides respectively.

3. The sprinkler, as recited in claim 1, wherein said tubular axle further has a water channel communicating with said accommodating cavity and a plurality of lateral water passageways radially and outwardly extended from said water channel to communicate with said nozzles respectively.

4. The sprinkler, as recited in claim 1, wherein said tubular axle further has a water channel communicating with said accommodating cavity and a plurality of lateral water passageways radially and outwardly extended from said water channel to communicate with said nozzles respectively.

5. The sprinkler, as recited in claim 3, wherein said base comprises a tubular sleeve rotatably receiving said tubular axle therein and a plurality of guiding conduits radially extended from said tubular sleeve to communicate with said water passageways respectively.

6. The sprinkler, as recited in claim 4, wherein said base comprises a tubular sleeve rotatably receiving said tubular axle therein and a plurality of guiding conduits radially extended from said tubular sleeve to communicate with said water passageways respectively.

7. The sprinkler, as recited in claim 5, wherein said control device further comprises an adjustment ring coaxially coupled at a bottom rim of said base to drive said base to rotate so as to selectively align one of said guiding conduits with any one of said water passageways.

8. The sprinkler, as recited in claim 6, wherein said control device further comprises an adjustment ring coaxially coupled at a bottom rim of said base to drive said base to rotate so as to selectively align one of said guiding conduits with any one of said water passageways.

9. The sprinkler, as recited in claim 6, wherein said tubular sleeve has an open top end that when said tubular axle is inserted through said tubular sleeve, said bridge is located above said top end of said tubular sleeve.

10. The sprinkler, as recited in claim 8, wherein said tubular sleeve has an open top end that when said tubular axle is inserted through said tubular sleeve, said bridge is located above said top end of said tubular sleeve.

11. The sprinkler, as recited in claim 4, wherein said water channel has a closed top end and said water passageways are perpendicular to said water channel at a position below said closed top end thereof.

12. The sprinkler, as recited in claim 10, wherein said water channel has a closed top end and said water passageways are perpendicular to said water channel at a position below said closed top end thereof.

13. The sprinkler, as recited in claim 1, further comprises a driven mechanism supported in said accommodating cavity of said housing and being operated in response to water pressure and water flowing direction.

14. The sprinkler, as recited in 12, further comprises a driven mechanism supported in said accommodating cavity of said housing and being operated in response to water pressure and water flowing direction.

* * * * *